US008197273B1

(12) United States Patent
Lee

(10) Patent No.: US 8,197,273 B1
(45) Date of Patent: Jun. 12, 2012

(54) GERMAN/FRENCH STYLE PLUG WITH MULTIPLE PIN ARRANGEMENTS

(75) Inventor: Chiu-San Lee, New Taipei (TW)

(73) Assignee: XYZ Science Co., Ltd., New Taipei (TW)

( * ) Notice: Subject to any disclaimer, the term of this patent is extended or adjusted under 35 U.S.C. 154(b) by 0 days.

(21) Appl. No.: 13/069,400

(22) Filed: Mar. 23, 2011

(51) Int. Cl.
*H01R 29/00* (2006.01)

(52) U.S. Cl. ..... 439/172

(58) Field of Classification Search ..... 439/171, 439/172, 175, 518, 640, 218, 956, 131, 133, 439/628
See application file for complete search history.

(56) References Cited

U.S. PATENT DOCUMENTS

| | | | | |
|---|---|---|---|---|
| 6,749,451 | B2 * | 6/2004 | Schmitt | 439/218 |
| 7,052,298 | B1 * | 5/2006 | Cheng | 439/171 |
| 7,179,105 | B1 * | 2/2007 | Hung | 439/172 |
| 7,300,297 | B1 * | 11/2007 | Wang | 439/173 |
| 7,354,286 | B1 * | 4/2008 | Lee | 439/172 |
| 7,946,868 | B1 * | 5/2011 | Chen | 439/173 |
| 2004/0038572 | A1 * | 2/2004 | Liu | 439/172 |
| 2004/0097114 | A1 * | 5/2004 | Shiroshita et al. | 439/174 |
| 2005/0153587 | A1 * | 7/2005 | Hsu et al. | 439/171 |
| 2006/0110963 | A1 * | 5/2006 | Cheng | 439/171 |
| 2007/0032109 | A1 * | 2/2007 | Hung | 439/172 |

* cited by examiner

*Primary Examiner* — Alexander Gilman
(74) *Attorney, Agent, or Firm* — Leong C. Lei

(57) ABSTRACT

A German/French style plug with multiple pin arrangements includes an outer enclosure, an inner housing, a stop plate, a constraint plate, and multiple plugging units. The plugging units are received in the outer enclosure and the inner housing. To move the plugging units, the constraint plate is first displaced to free the plugging units. The plugging units have operation pegs that are operable to have pins of the plugging units projecting out of through holes defined in the outer enclosure or through openings defined in the inner housing. The second plugging unit has a constraint section that is movably received in a constraint slot defined in the inner housing, whereby the movement of the second plugging may cause extension of the inner housing to form a stepped configuration to provide an additional plug structure for different socket specifications.

10 Claims, 27 Drawing Sheets

GERMAN/FRENCH STYLE PLUG WITH MULTIPLE PIN ARRANGEMENTS

TECHNICAL FIELD OF THE INVENTION

The present invention generally relates to a German/French style plug with multiple pin arrangements that satisfy multiple socket specifications of diverse countries/areas.

DESCRIPTION OF THE PRIOR ART

Electrical appliances used in different countries of the world are often powered by direct current (DC) that is converted from alternate current (AC). This measure has been widely used. Since AC voltage of 110V or 220V, after being converted into DC power, generally complies with safety regulations for use, such a rating of electrical current can protect electrical products and is commonly adopted worldwide. However, configurations of electrical plugs used worldwide are different from one country/area to another country/area and this causes troubles to the manufacturers and the consumers. Although various adaptors, which can be structured for one-to-one conversion or convertible among multiple pin configurations, are available in the market for selective connection with a regular plug as desired, or providing variation of the plug configuration for selective extension of different conductive pins to mate sockets of rare styles. These known devices do not provide a structure that actually satisfies multiple socket specifications adopted in diverse countries/areas and may sometimes be troublesome for a number of adaptive plugging accessories must be carried.

Further, multi-pin adaptors that are currently available in the market are not provided with grounding features. This makes them not meeting the needs of grounding desired by some manufacturers.

SUMMARY OF THE INVENTION

A primary objective of the present invention is to provide a multiple-in-one type portable plug that combines various pin arrangements to satisfy various socket specifications adopted in different countries/areas. To achieve the above objective, the following technical solution is adopted. The present invention provides a German/French style plug with multiple pin arrangements, which comprises an outer enclosure, an inner housing, a stop plate, a constraint plate, and multiple plugging units. The multiple plugging units include a first plugging unit, a second plugging unit, and a third plugging unit. The plugging units are arranged in the outer enclosure and/or the inner housing and are each provided with an operation peg. The operation pegs are movable along a plurality of slide channels defined in a side wall of the outer enclosure. To move the operation pegs, the constraint plate is first displaced away from a home position to set the operation pegs in a freely movable condition. Operating the operation pegs may cause extension of pins of the plugging units through holes defined in the outer enclosure or openings defined in the inner housing for insertion into mateable electrical main sockets. The second plugging unit comprises a constraint section, which is movably received in a constraint slot defined in the inner housing. This structural arrangement allows the inner housing to project outwards to form a stepped configuration, making the second plugging unit further extending to form a different model for connection with electrical main.

A secondary objective of the present invention is to selectively mount a grounding conductive member according to the environment of use in order to meet the needs of users.

A further objective of the present invention is to provide a plug that is compact in size and easy to carry.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
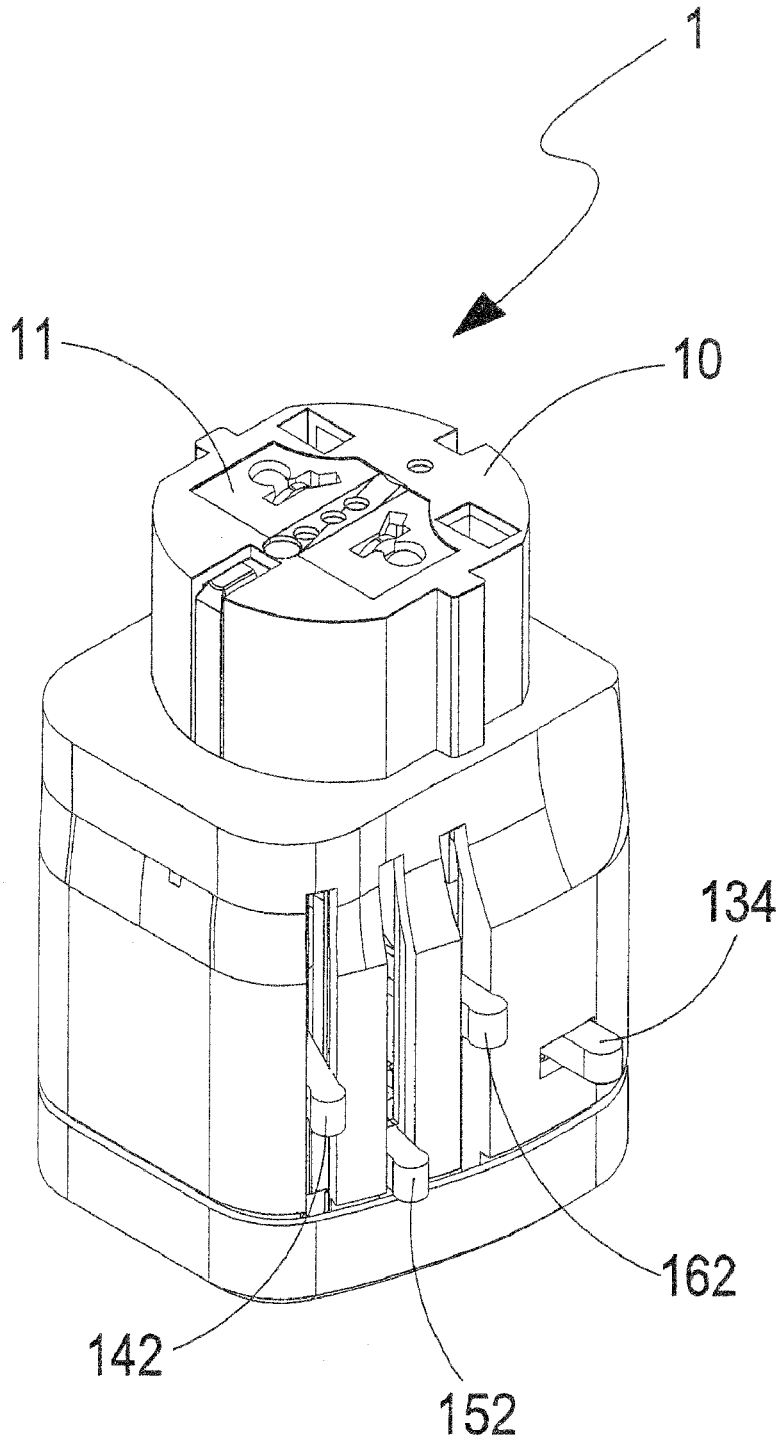
FIG. 1 is a perspective view showing a preferred embodiment of the present invention.
Figure 2:
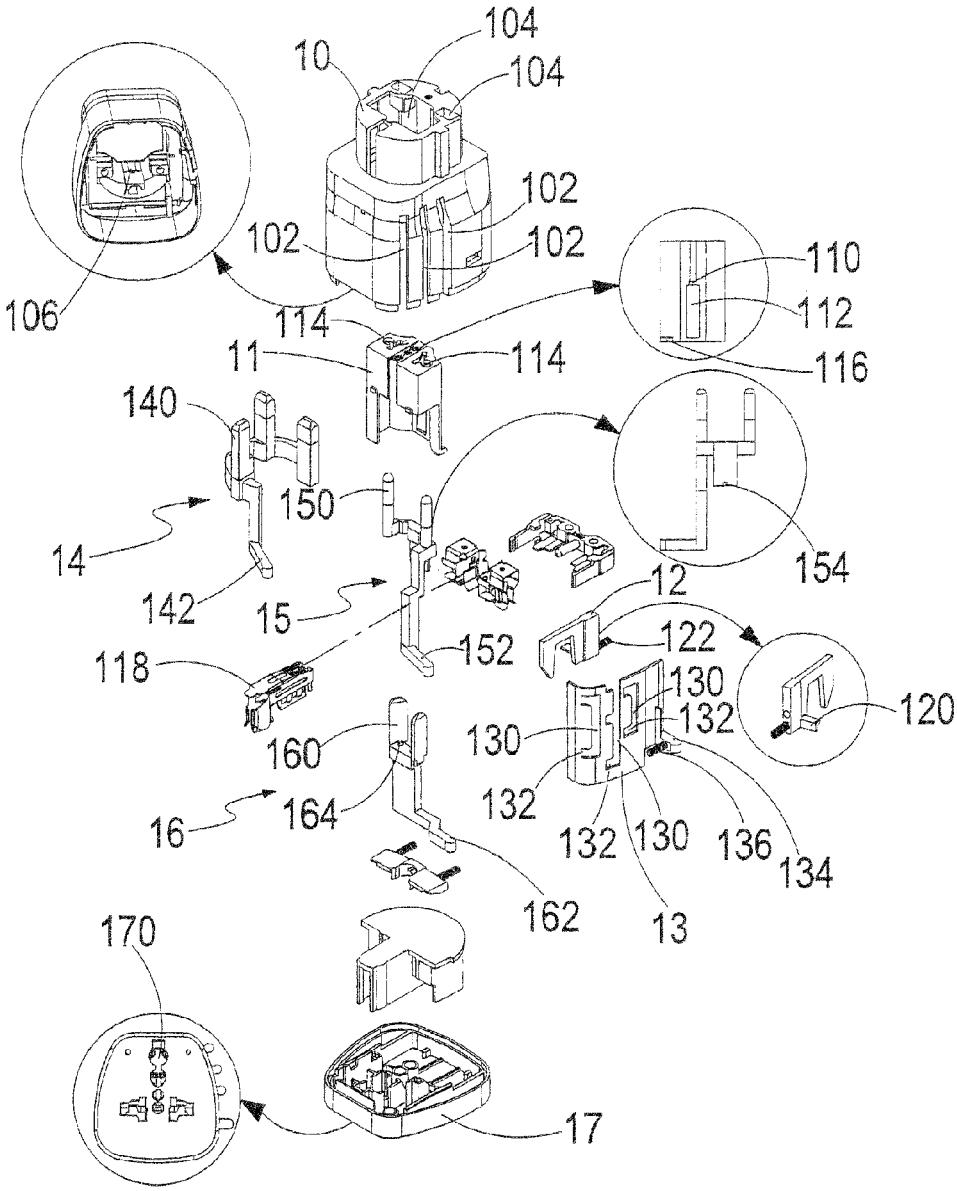
FIG. 2 is an exploded view of the preferred embodiment of the present invention.

Referring to FIGS. 1 and 2, which are respectively a perspective view and an exploded view of a preferred embodiment according to the present invention, these drawings show a German/French style plug with multiple pin arrangements according to the present invention. The German/French style plug 1 mainly comprises an outer enclosure 10, an inner housing 11, a stop plate 12, a constraint plate 13, and a first plugging unit 14, a second plugging unit 15 and a third plugging unit 16. The outer enclosure 10 has a side wall in which a plurality of slide channels 102 is formed and a top wall adjacent to the side wall and forming a plurality of through holes 104. The outer enclosure 10 forms therein a constraint rail 106, and the outer enclosure 10 receives the inner housing 11 therein. The inner housing 11 has a wall forming a constraint member 110 that is matingly engageable with the constraint rail 106 and also forms a constraint slot 112 at a location close to the constraint member 110. The inner housing 11 has a top forming a plurality of through openings 114. Further, the inner housing 11 forms a retention projection 116 extending from an outer surface thereof and the retention projection 116 is engageable with a retention trough 120 that is formed in a portion projecting from a predetermined location of the stop plate 12, whereby the stop plate 12 that is received in the outer enclosure 10 blocks a portion of the constraint passage 130 along which the second plugging unit 15 is movable. The second plugging unit 15 is movable in a limited way as being constrained by the inner housing 11 to exhibit difference in vertical position. Further, the constraint plate 13 that is received in the outer enclosure 10 forms a plurality of constraint passages 130 respectively corresponding to the slide channels 102 and each of the constraint passages 130 comprises a plurality of locking sections 132. The constraint plate 13 comprises a switching member 134 projecting therefrom to extend through one of the slide channels 102 for an operation of position switching of the switching member. The stop plate 12 and the constraint plate 13 are respectively provided with elastic members 122, 136 that are supported on inside walls of the outer enclosure 10. The first plugging unit 14, the second plugging unit 15, and the third plugging unit 16 are each provided with at least one conductive pin 140, 150, 160 (multiple pins being shown in the drawings) and an operation peg 142, 152, 162 movably received in the respective one of the slide channels 102 and constrained by the respective one of the constraint passages 130. The conductive pins 140 of the first plugging unit 14 are received through the through holes 104 of the outer enclosure 10 and the conductive pins 140 can be made of various materials according the desired applications (such as plastics and metals). The conductive pins 150 of the second plugging unit 15 are received through the through openings 114, and a constraint section 154 is formed on a predetermined location of the second plugging unit 15, whereby the constraint section 154 constrains the second plugging unit 15 within the constraint slot 112. Further, the conductive pins 160 of the third plugging unit 16 are received through the through openings 114, and the third plugging unit 16 is provided with rotation members 164 for rotating the conductive pins 160 in order to change the directions of the conductive pins 160.

Figure 19:
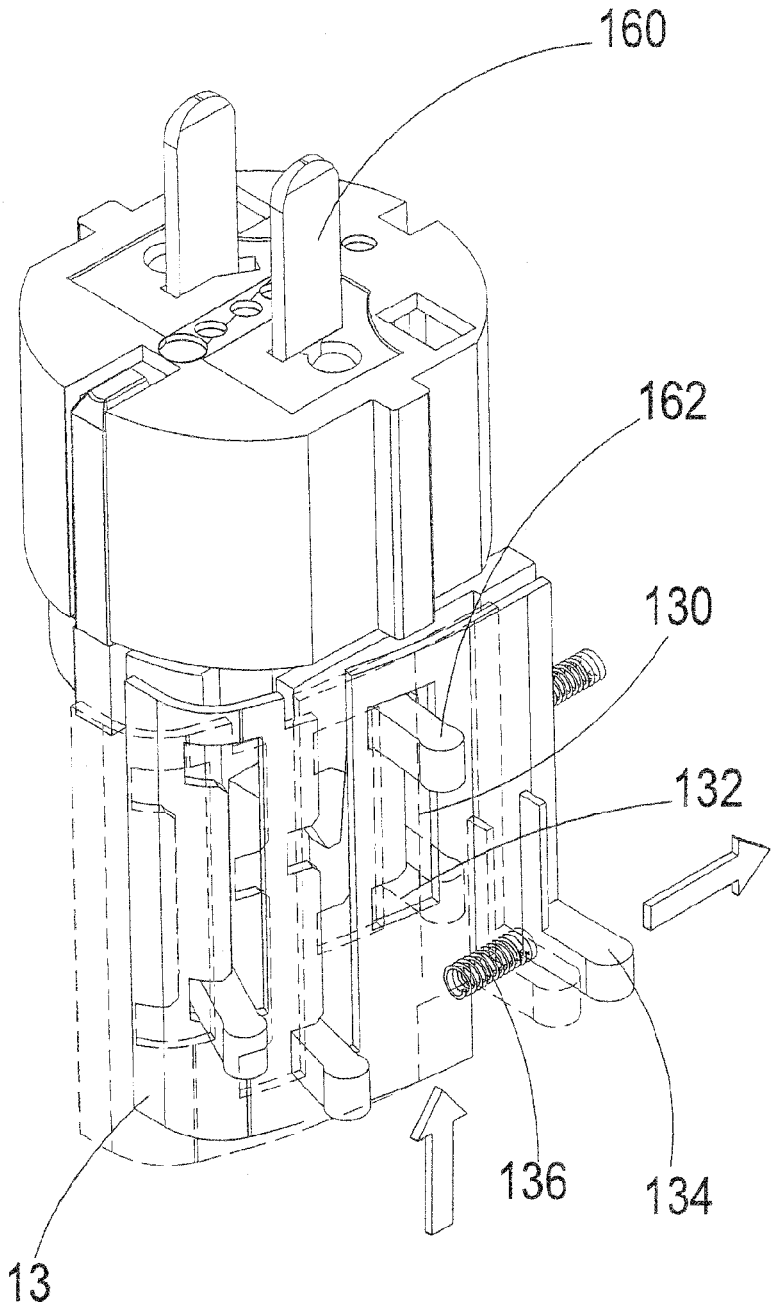
FIG. 19 is a perspective view illustrating internal component movement associated with the operation of FIG. 18.

The outer enclosure 10 is mounted to a base 17. The base 17 form a plurality of coupling holes 170 that function to receive insertion of an external plug (not shown) and are in electrical connection with the plugging units 14, 15, 16 (also see FIG. 19). A conductive spring plate 118 is arranged inside the outer enclosure 10, and the conductive spring plate 118 provides electrical engagement with a grounding conductive member 2.

Figure 3:
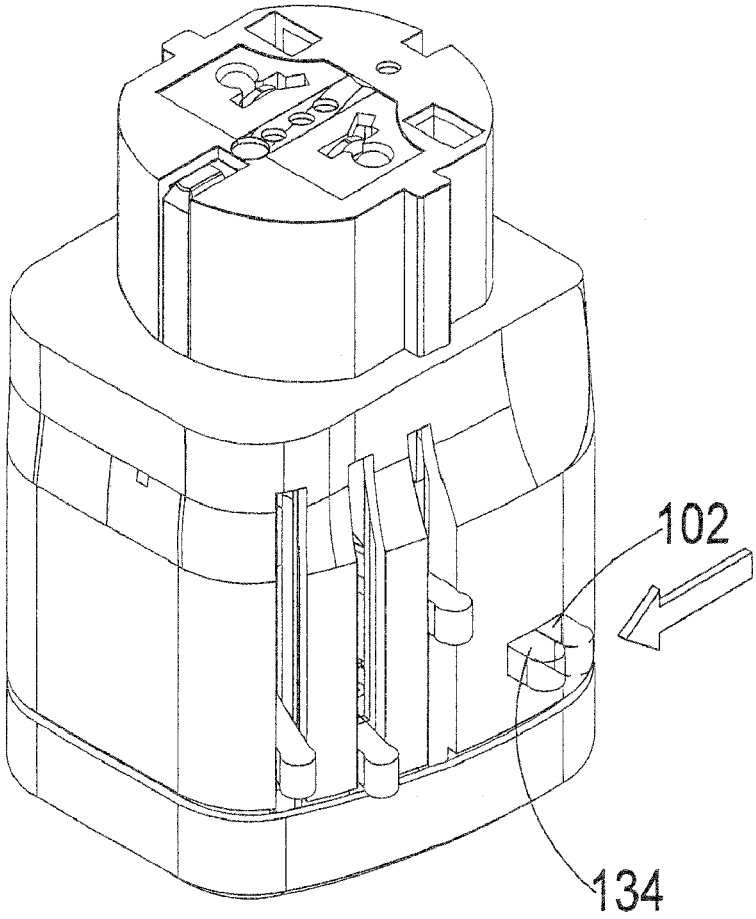
FIG. 3 is perspective view demonstrating a first phase of an operation of a first plugging unit (British style pin arrangement) according to the present invention.
Figure 4:
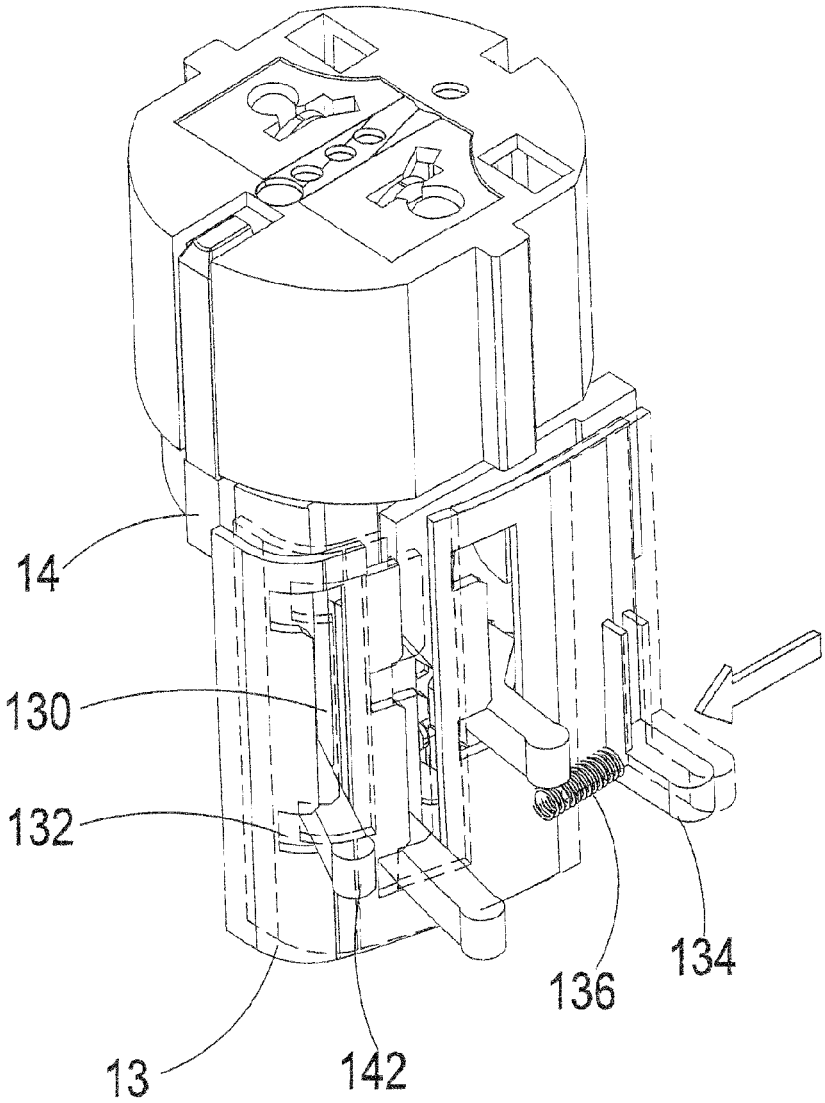
FIG. 4 is a perspective view illustrating internal component movement associated with the operation of FIG. 3.
Figure 5:
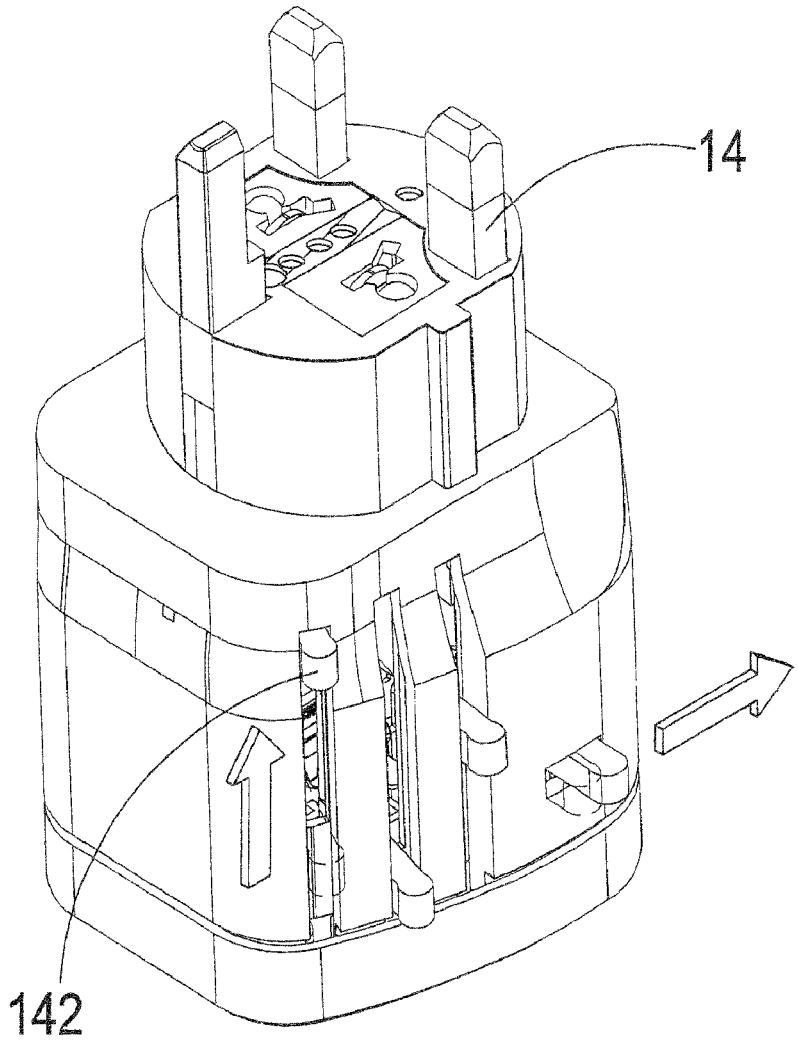
FIG. 5 is a perspective view demonstrating a second phase of the operation of the first plugging unit (British style pin arrangement) according to the present invention.
Figure 6:
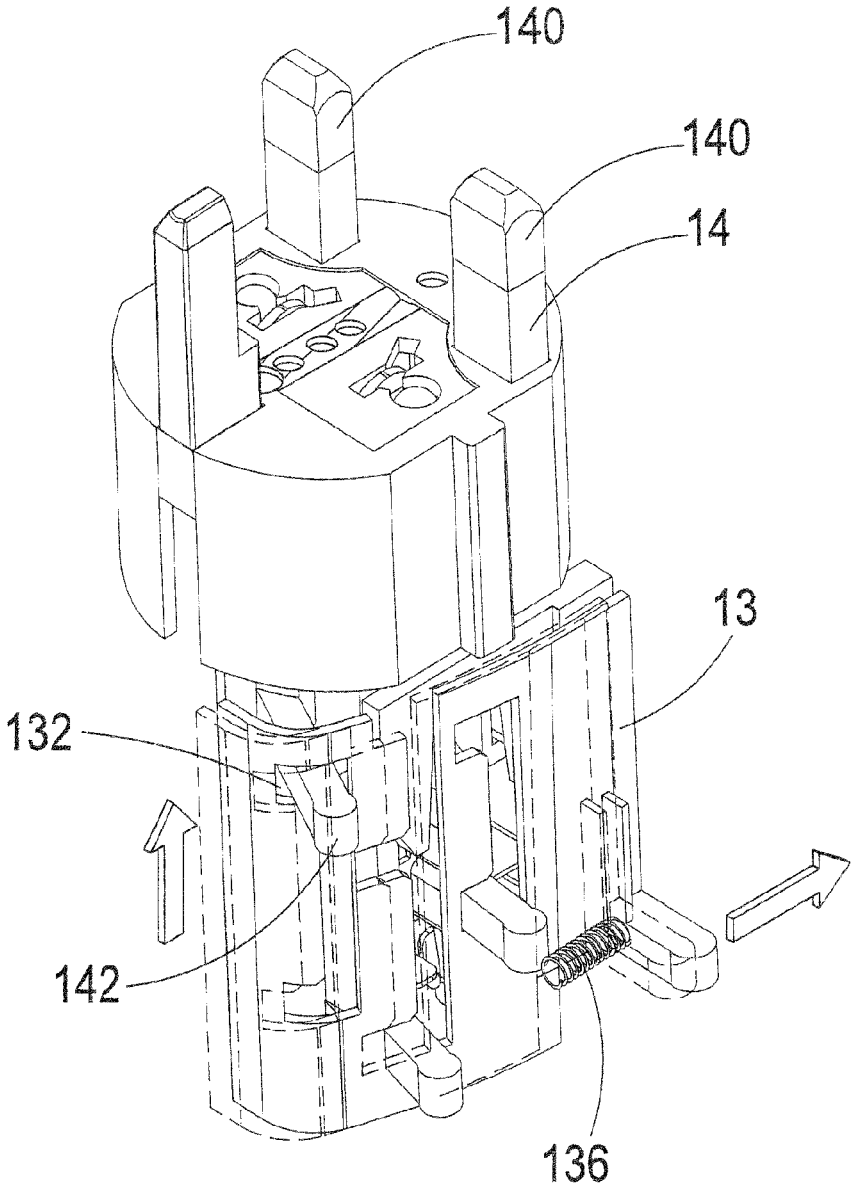
FIG. 6 is a perspective view illustrating internal component movement associated with the operation of FIG. 5.

Also referring to FIGS. 3, 4, 5, 6, and 7, which are respectively a perspective view demonstrating a first phase of an operation of the first plugging unit (British style pin arrangement), a perspective view illustrating internal component movement associated with the operation of FIG. 3, a perspective view demonstrating a second phase of the operation of the first plugging unit (British style pin arrangement), a perspective view illustrating internal component movement associated with the operation of FIG. 5, and a perspective view demonstrating installation of the grounding conductive member, these drawings clearly show that to use the British style pin arrangement, the operation and structure are as follows. Firstly, the switching member 134 of the constraint plate 13 is pushed to cause the switching member 134 to move along the slide channel 102. Under this condition, the elastic member 136 of the constraint plate 13 is compressed. Since the constraint plate 13 is moved, for example, rightwards, the operation peg 142 of the first plugging unit 14 is moved from one of the locking sections 132, where the operation peg is originally located, into the associated constraint passage 130. This allows a user to push the operation peg 142 upward, thereby making the conductive pins 140 of the first plugging unit 14 projecting outwards.

Once the operation peg 142 is moved to the uppermost position, the constraint plate 13 is driven by the spring force released from the elastic member 136 to return to the original position, so as to have the operation peg 142 entering and engaging another one of the locking sections 132, thereby effectively securing the first plugging unit 14 in the locking section. On the other hand, to retract the conductive pins 140 of the first plugging unit 14, a revered operation is performed. The above descried process configures the first plugging unit 14 as a British style plug.

Figure 7:
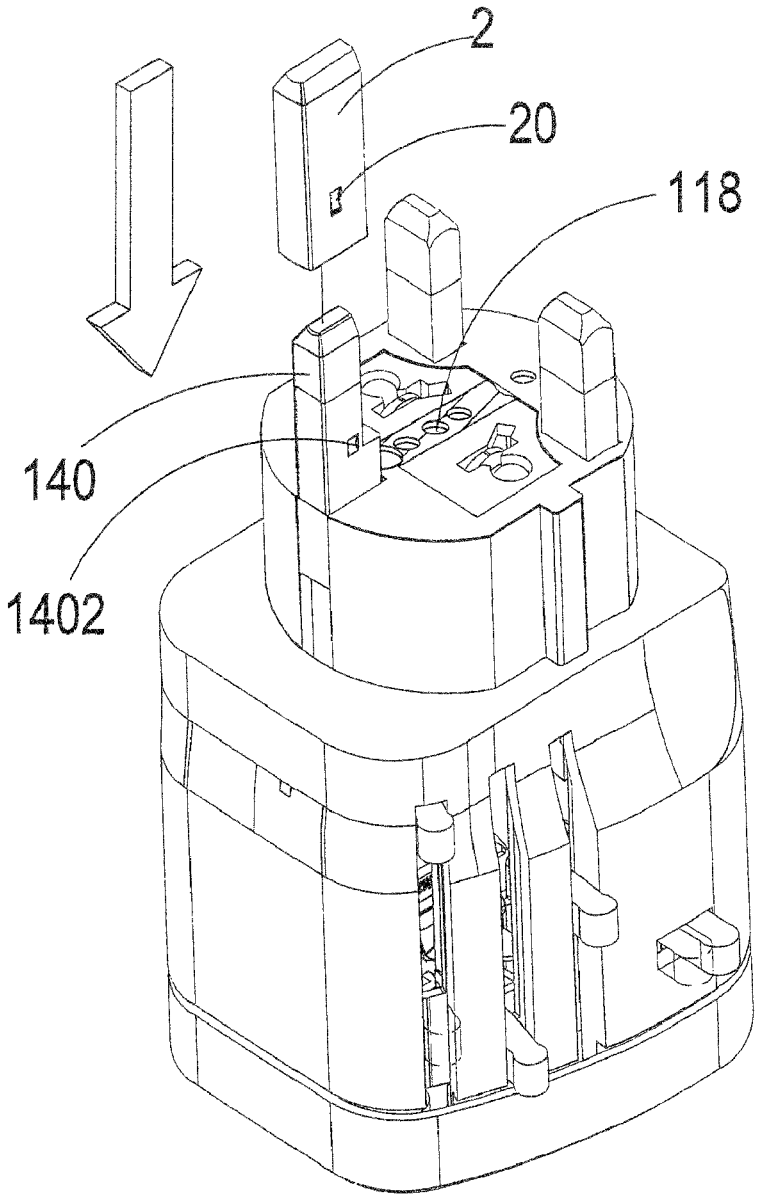
FIG. 7 is a perspective view demonstrating installation of a grounding conductive member for the British style pin arrangement.

FIG. 7 shows that the grounding conductive member 2 is directly fit over one of the conductive pins 140 of the first plugging unit 14. The one of the conductive pins 140 is provided with a retention member 1402, and the retention member 1402 is arranged for selective engagement with and thus retaining a retention barb 20 formed on the grounding conductive member 2. Since this conductive pin 140 is connected to the conductive spring plate 118, grounding can be realized.

Figure 8:
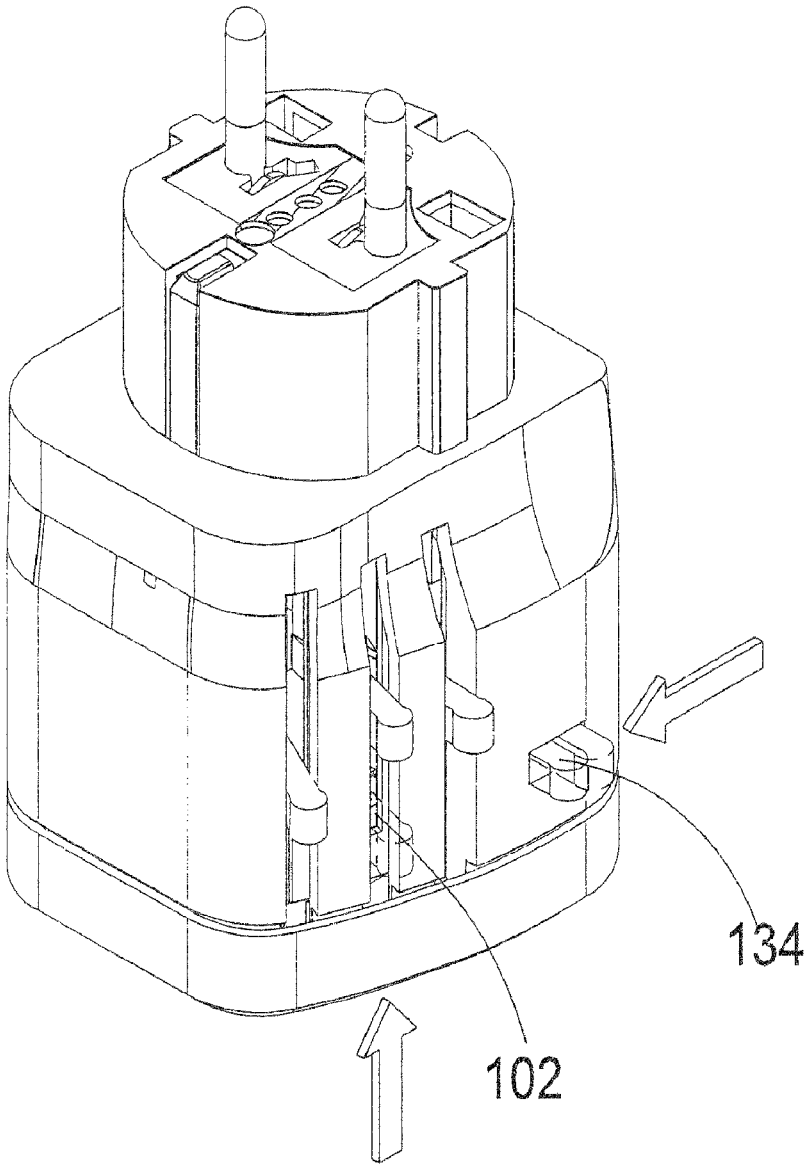
FIG. 8 is a perspective view demonstrating an operation of a second plugging unit (German/French style pin arrangement) according to the present invention.
Figure 9:
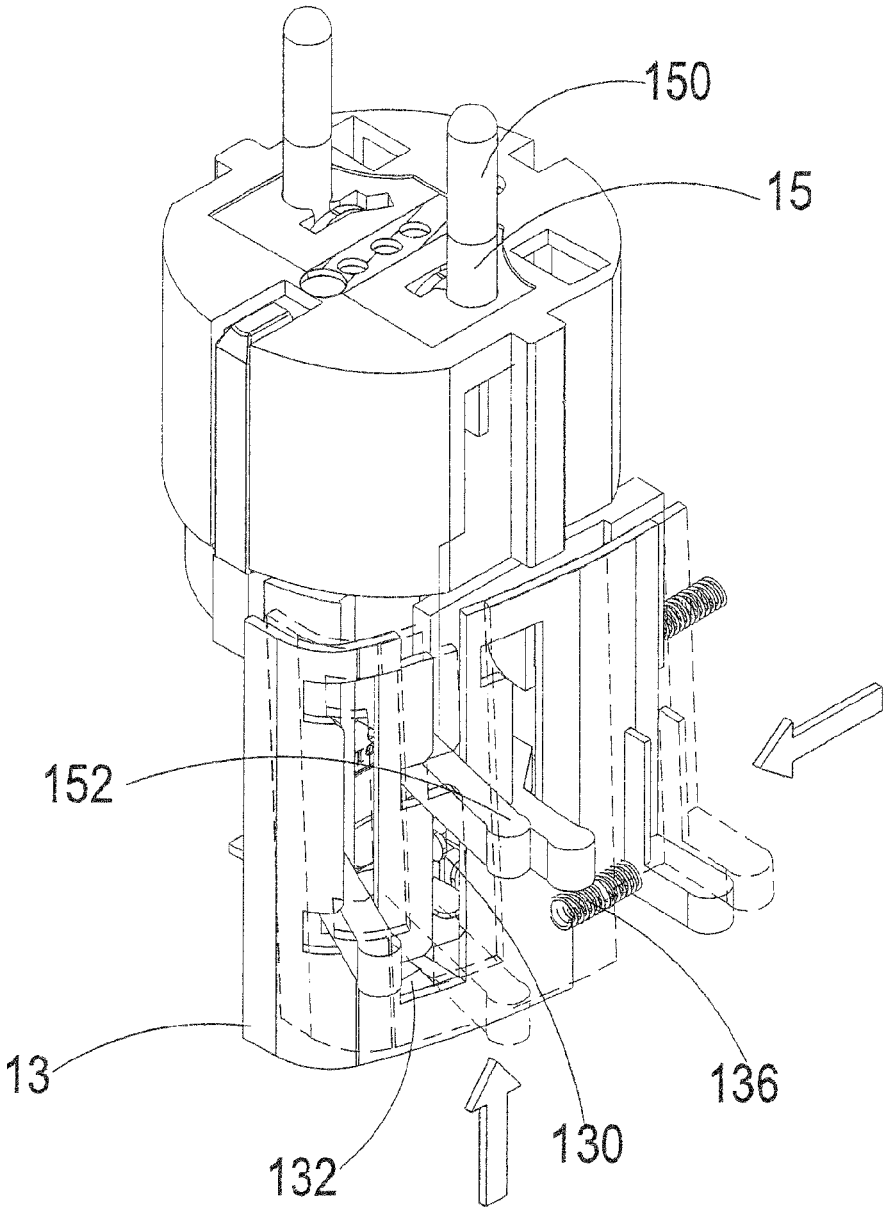
FIG. 9 is a perspective view illustrating internal component movement associated with the operation of FIG. 8.
Figure 10:
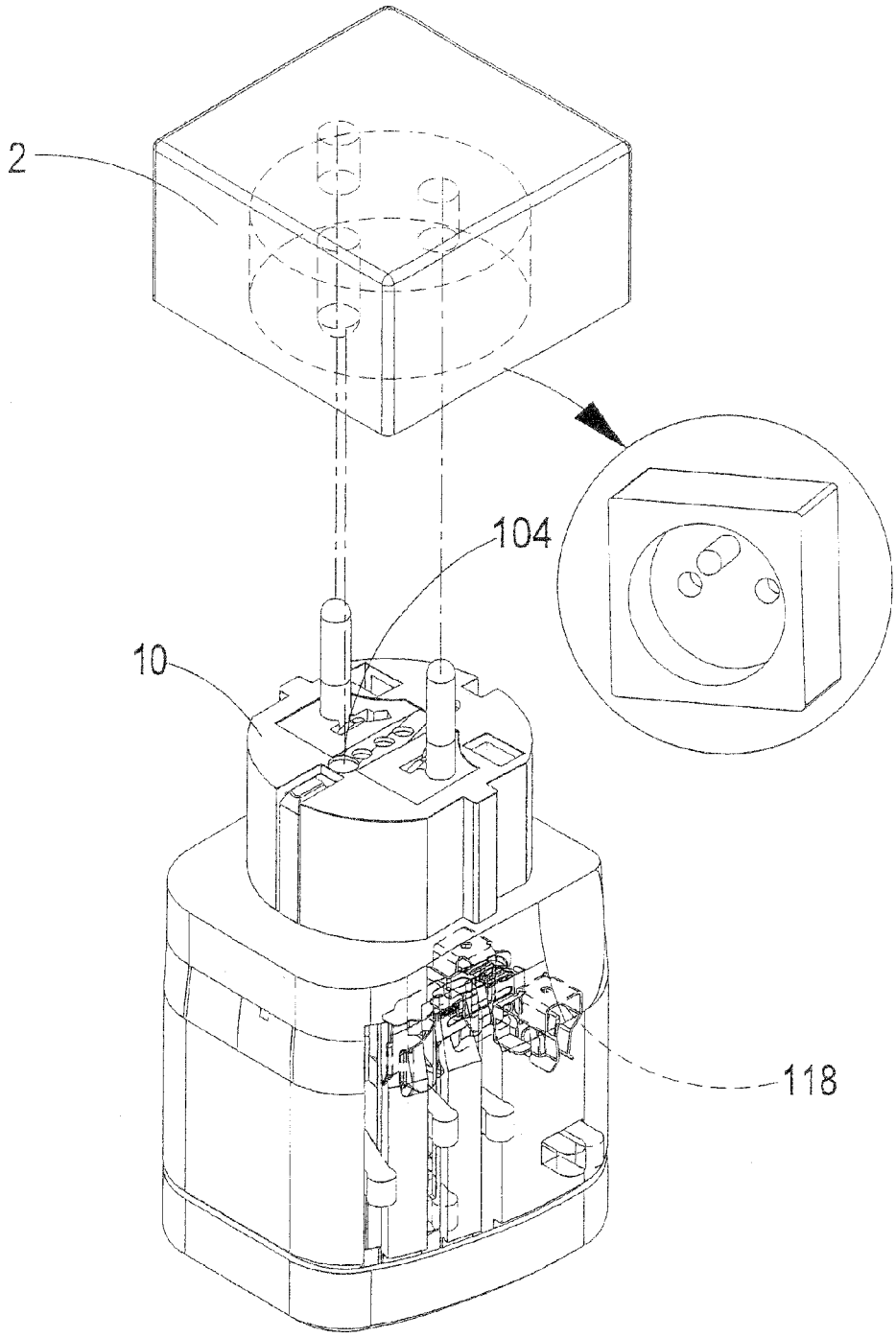
FIG. 10 is a perspective view demonstrating installation of a grounding conductive member for the German/French pin arrangement.

Referring to FIGS. 8, 9, and 10, which are respectively a perspective view demonstrating an operation of the second plugging unit (German/French style pin arrangement), a perspective view illustrating internal component movement associated with the operation of FIG. 8, and a perspective view demonstrating installation of the grounding conductive member for the German/French pin arrangement. To use the German/French pin arrangement, the operation and structure are as follows. Firstly, the switching member 134 of the constraint plate 13 is pushed to cause the switching member 134 to move along the slide channel. 102. Under this condition, the elastic member 136 of the constraint plate 13 is compressed. Since the constraint plate 13 is moved, for example, rightwards, the operation peg 152 of the second plugging unit 15 is moved from one of the locking sections 132, where the operation peg is originally located, into the associated constraint passage 130. This allows a user to push the operation peg 152 upward, thereby making the conductive pins 150 of the second plugging unit 15 projecting outwards.

Due to the constraint section 154 being formed on a predetermined location of the second plugging unit 15, the constraint section 154 constrains the second plugging unit 15 to move along the constraint slot 112.

When the operation peg 152 is pushed upward to reach a middle section, the constraint plate 13 is driven by the spring force released from the elastic member 136 to return to the original position, so as to have the operation peg 152 entering and engaging one of the locking sections 132 formed in the middle section, thereby effectively securing the second plugging unit 15 in the locking section. This process configures the second plugging unit 15 as a German/French style plug.

Figure 10A:
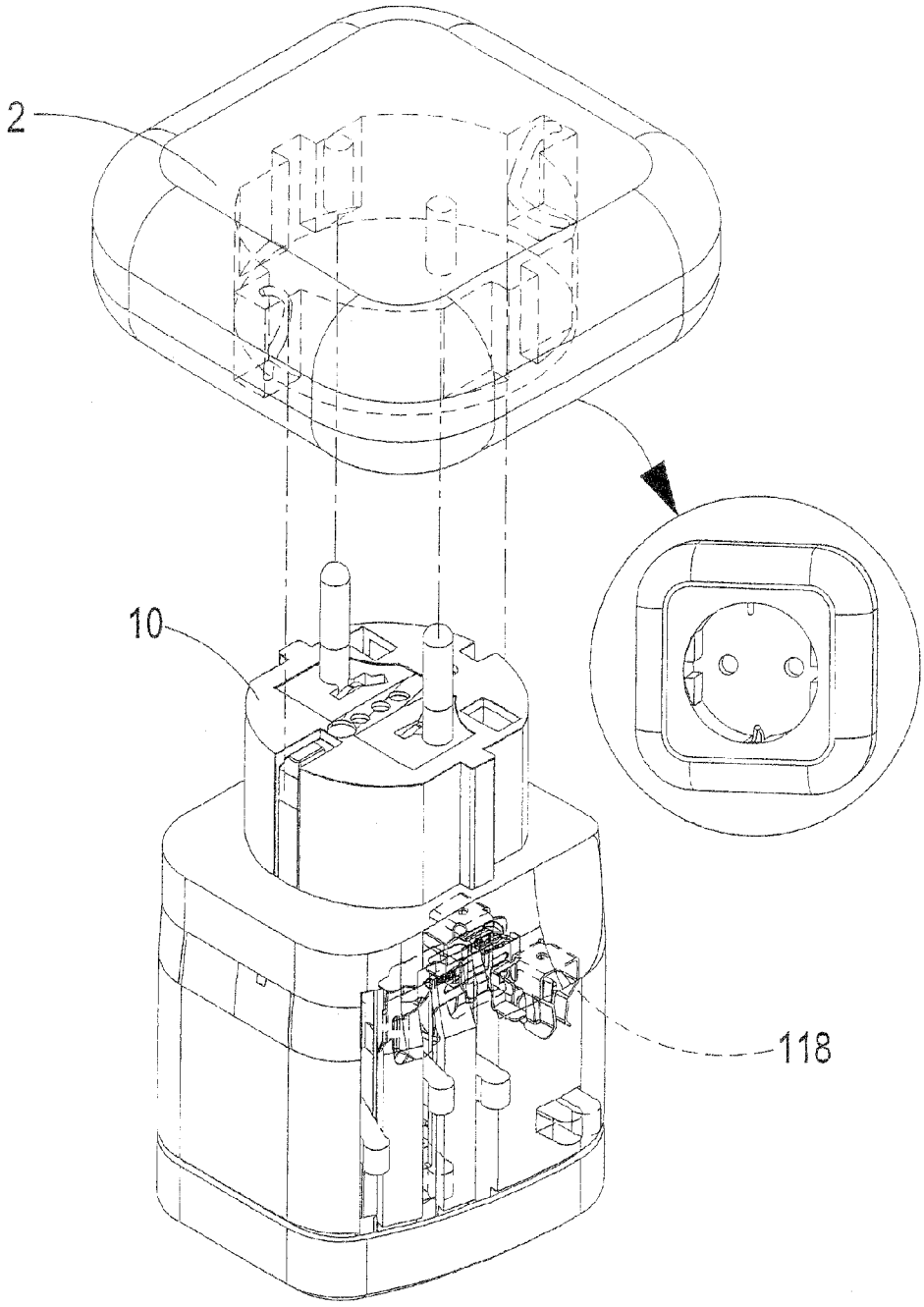
FIG. 10*a* is a perspective view demonstrating installation of a grounding conductive member for German/French pin arrangement.

FIGS. 10 and 10*a* illustrate that the grounding conductive member 2 of a French style plug can be directly fit into the through hole 104 formed in the top wall of the outer enclosure 10. Thus, a user may insert the grounding conductive member 2 into the through hole 104 according to the local voltage requirement and having the grounding conductive member 2 connected to the conductive spring plate 118. In this way, leaking current from an electrical appliance can be conducted to ground and the user may be protected against risk of electrical shock.

Figure 10B:
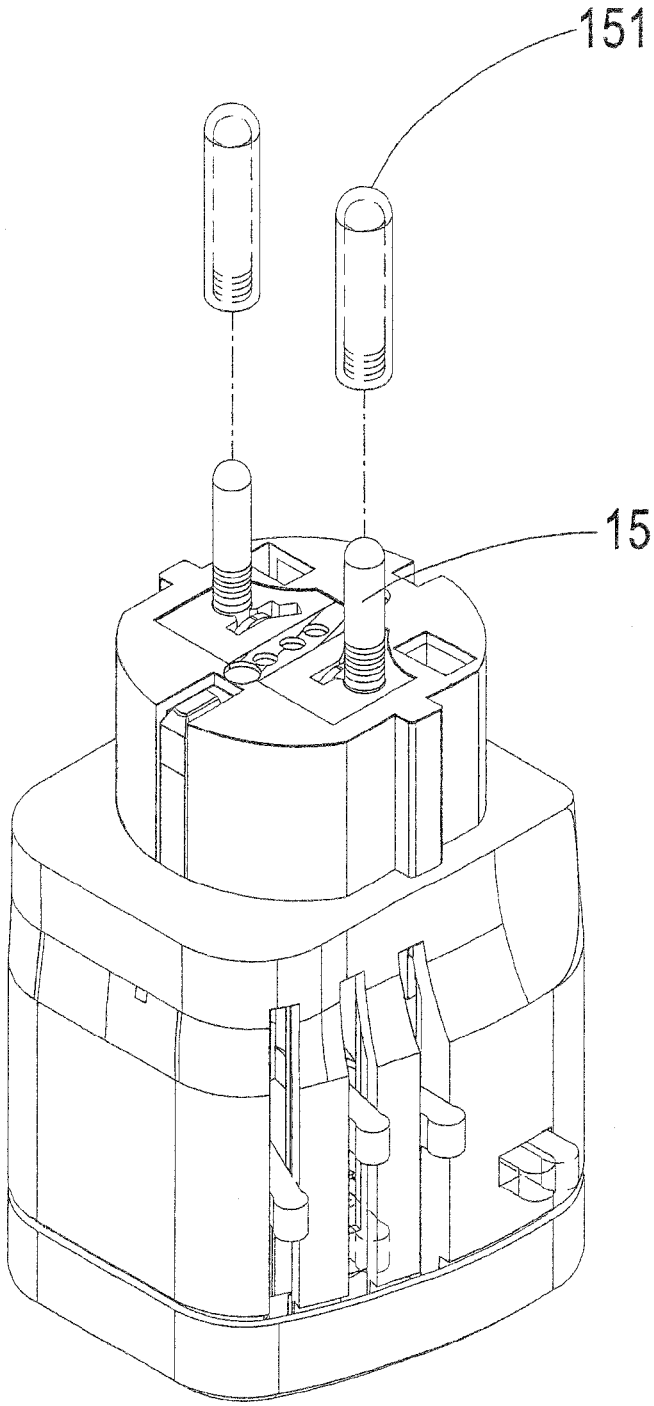
FIG. 10*b* is a perspective view demonstrating installation of conductive sleeves.

FIG. 10*b* illustrates that to meet the requirements for different voltages, conductive sleeves 151 (used for such as 16 A and 250V, and having a diameter of 4.8 mm) can be provided to attach, through threading engagement, to the second plugging unit 15 (used for such as 10 A and 250V, and having a diameter of 4.0 mm). Thus, a user may selectively install the conductive sleeves 151 according to local voltage requirement.

Figure 10C:
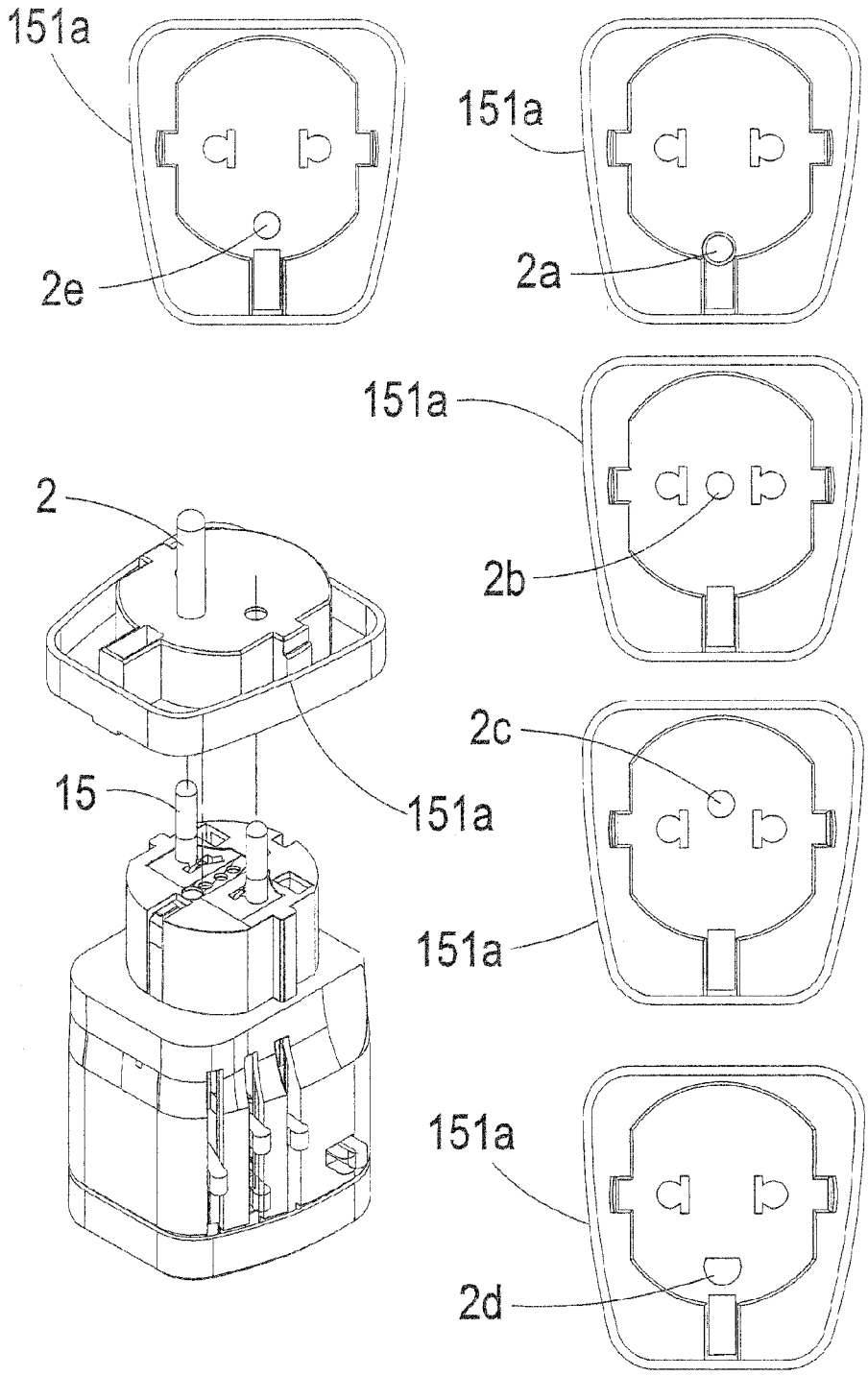
FIG. 10*c* is a perspective view demonstrating installation of conductive sleeves for different countries/areas.
Figure 11:
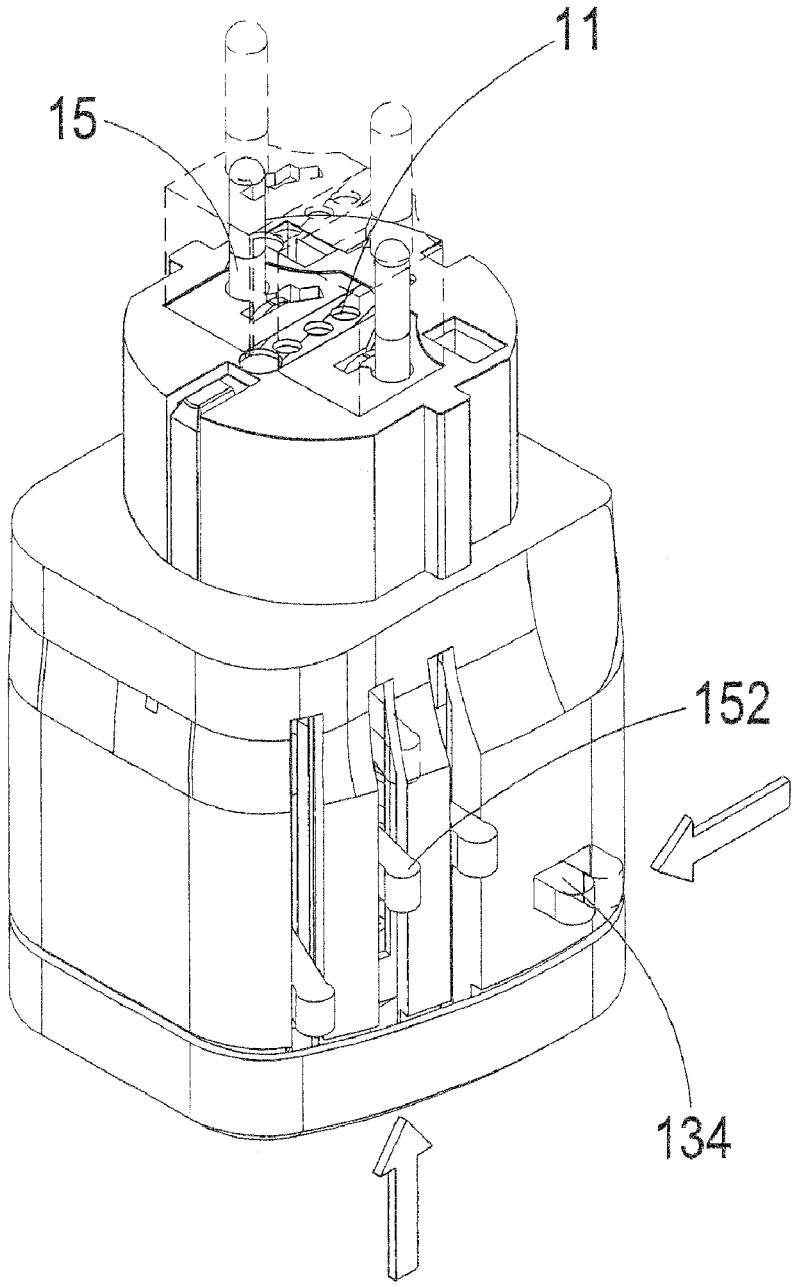
FIG. 11 is a perspective view demonstrating a first phase of a combined operation of extension of an inner housing according to the present invention and operation of the second plugging unit (European style pin arrangement).
Figure 12:
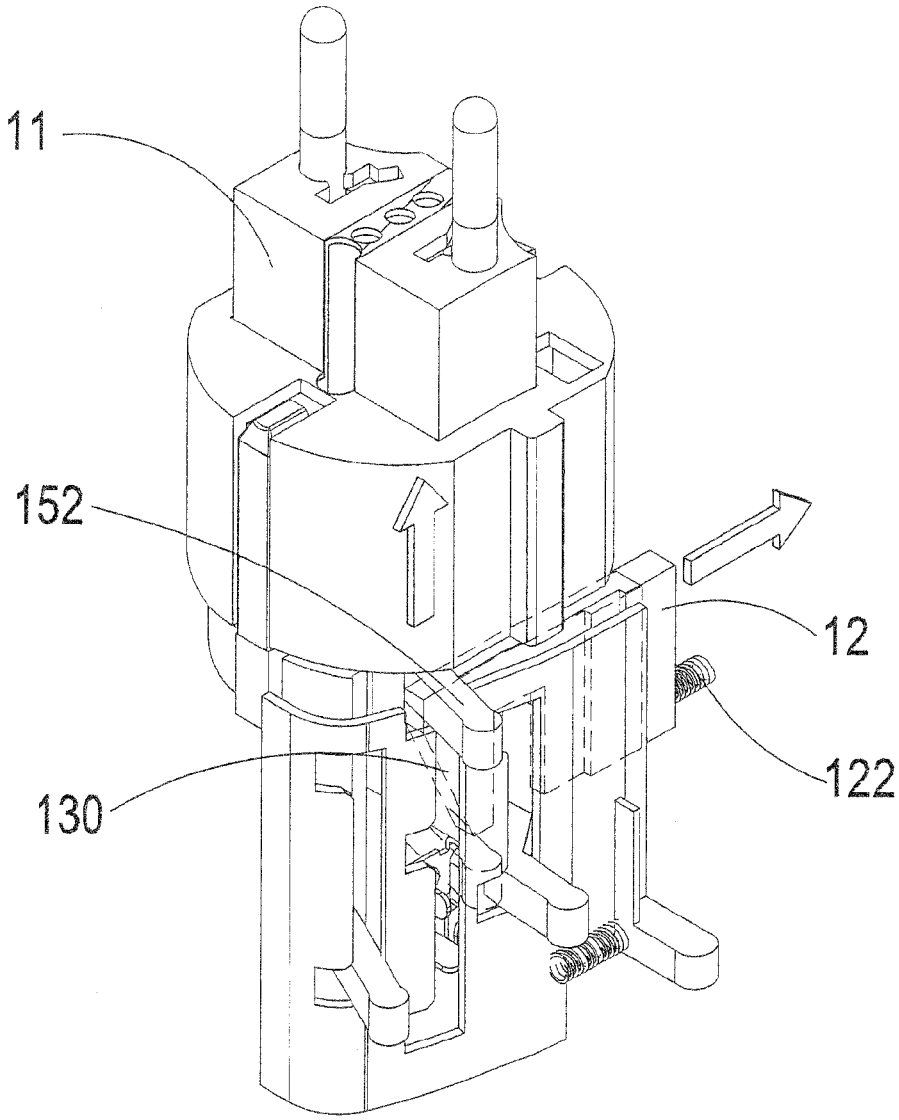
FIG. 12 is a perspective view illustrating internal component movement in a second phase of the combined operation of extension of the inner housing and the operation of the second plugging unit (European style pin arrangement).
Figure 13:
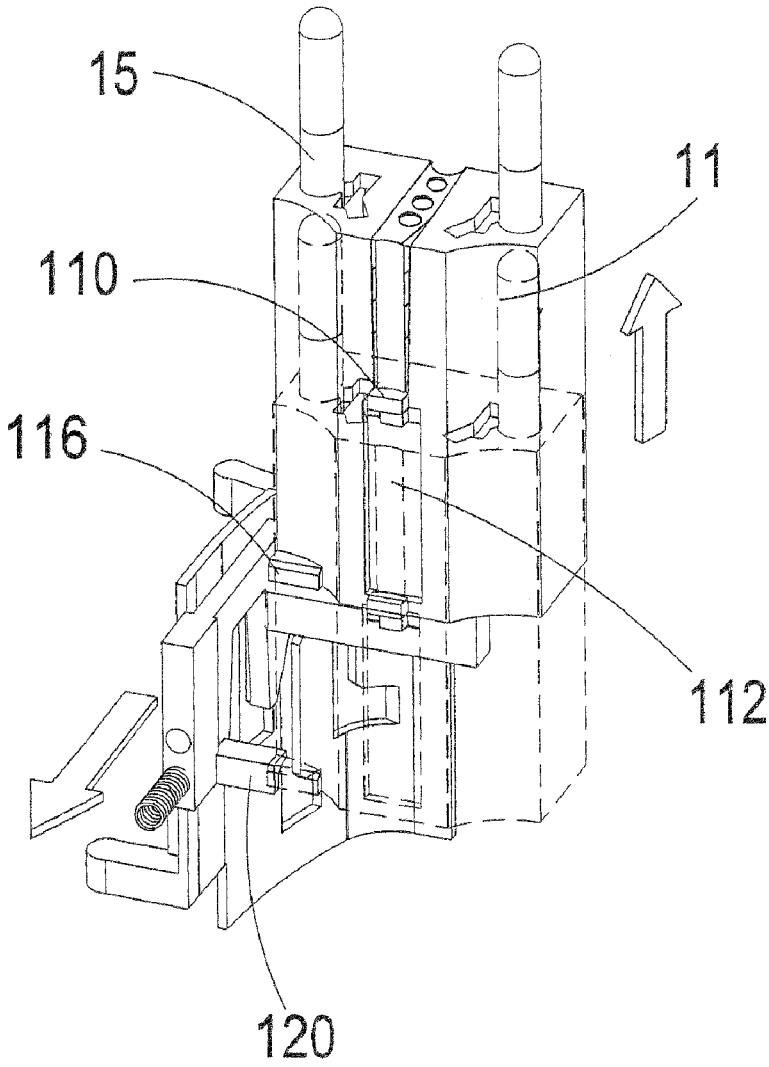
FIG. 13 is a perspective view illustrating associated movement of the inner housing and a stop plate according to the present invention.
Figure 14:
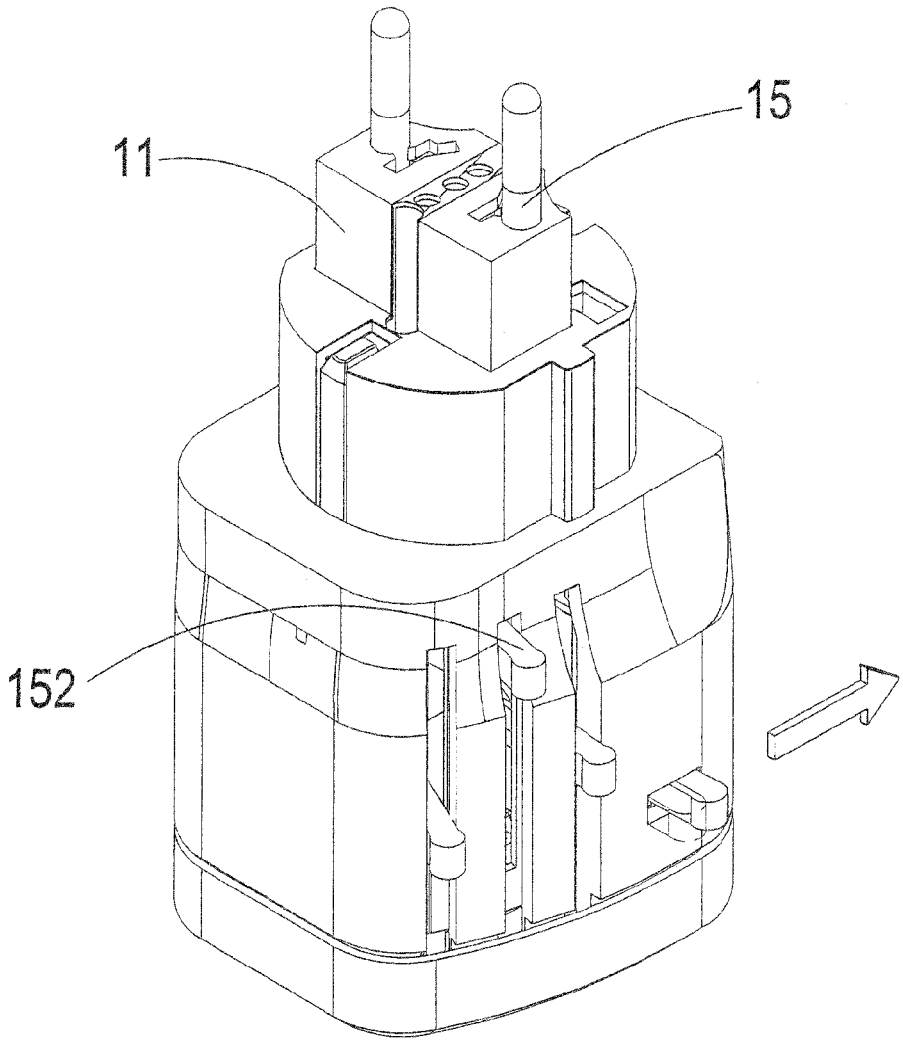
FIG. 14 is a perspective view illustrating the extension of the inner housing according to the present invention.

FIG. 10*c* is a perspective view illustrating installation of various conductive sleeves for different countries/areas. To meet the different voltage requirements in different countries/areas, a proper conductive sleeve 151*a* that comprises a grounding conductive member 2 can be directly fit to the second plugging unit 15. This drawing also shows various grounding conductive member 2 used in different countries/areas, such as a grounding conductive member 2*a* for use in India, a grounding conductive member 2*b* for use in Italy (old style plug), a grounding conductive member 2*c* for use in Swiss (old style plug), a grounding conductive member 2*d* for use in Denmark, and a grounding conductive member 2*e* for use in the Middle East. Thus, a user may selectively install these conductive sleeves 2 according to local voltage requirement and to realize grounding.

Referring FIGS. 11, 12, 13, 14, and 15, which are respectively a perspective view demonstrating a first phase of a combined operation of extension of the inner housing according to the present invention and operation of the second plugging unit (European style pin arrangement), a perspective view illustrating internal component movement in a second phase of the combined operation, a perspective view illustrating associated movement of the inner housing and the stop plate, a perspective view illustrating the extension of the inner housing, and a perspective view demonstrating installation of the grounding conductive member for the European style pin arrangement, to use the European style pin arrangement, in order to extend the inner housing 11 in an upward direction, the switching member 134 is pushed against to allow the constraint plate 13 to move again. Under this condition, the operation peg 152 is moved further upward. During such a further upward movement, the portion of the constraint passage 130 along which the second plugging unit 15 is movable that is original blocked by the stop plate 12 is cleared due to a forced sideway displacement of the stop plate 12 and at the same time when the stop plate 12 is sideway displaced, the retention trough 120 of the stop plate 12 is allowed to disengage from the retention projection 116 that extend from a predetermined location of the outer surface of the inner housing 11 so as to set the inner housing 11 in a freely movable condition. Afterwards, with the operation peg 152 being moved upwards, due to the constraint section 154 of the second plugging unit 15 engaging and thus being retained by an upper end of the constraint slot 112 of the inner housing 11, the upward movement of the opening peg causes the inner housing 11 to move therewith and thus extending out of the outer enclose to form a step like configuration. This process configures a European style plug.

Figure 15:
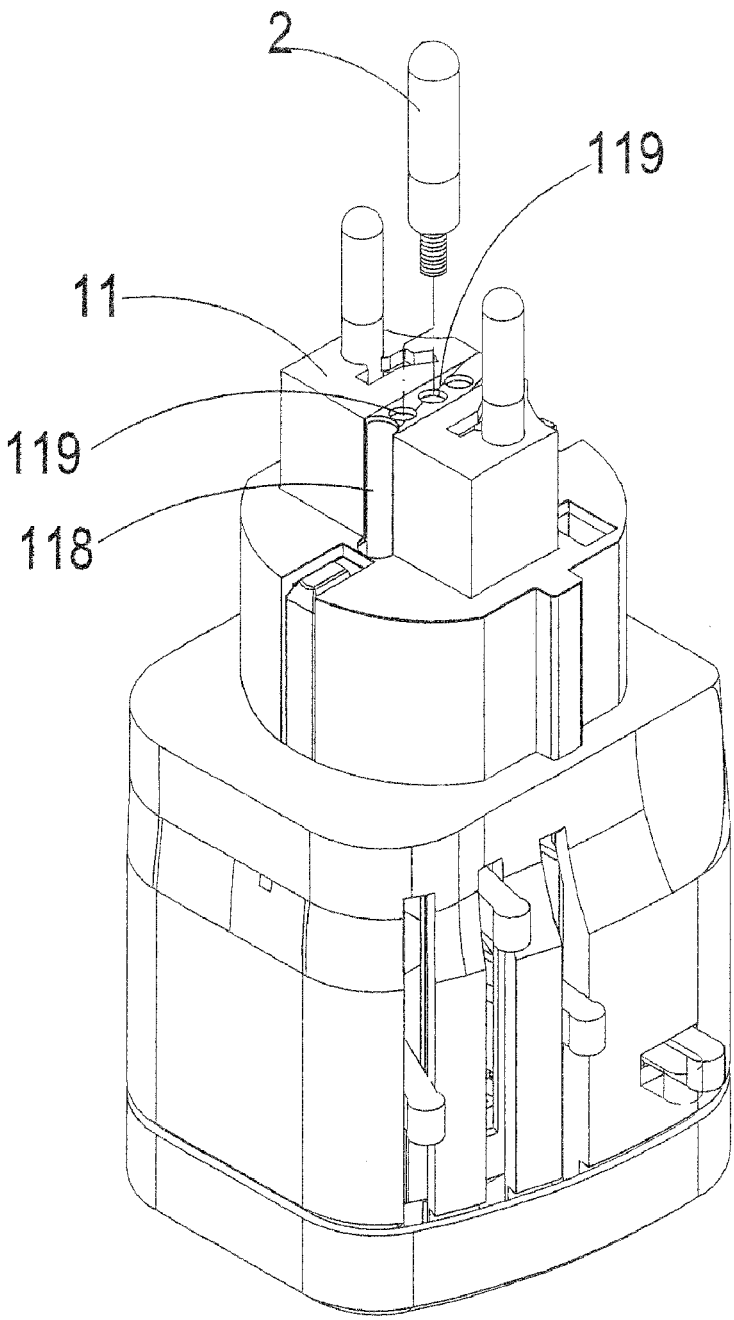
FIG. 15 is a perspective view demonstrating installation of a grounding conductive member for a European, Italian, and Swiss style pin arrangement.

FIG. 15 illustrates that the grounding conductive member 2 can be directly secured, through threading engagement, to one of a number of through holes 119 defined in the top of the inner housing 11. Thus, a user may selectively install the grounding conductive member 2 through threading engagement with the through hole 119 according to local voltage requirement and having the grounding conductive member 2 connected to the conductive spring plate 118. In this way, leaking current from an electrical appliance can be conducted to ground and the user may be protected against risk of electrical shock.

Figure 16:
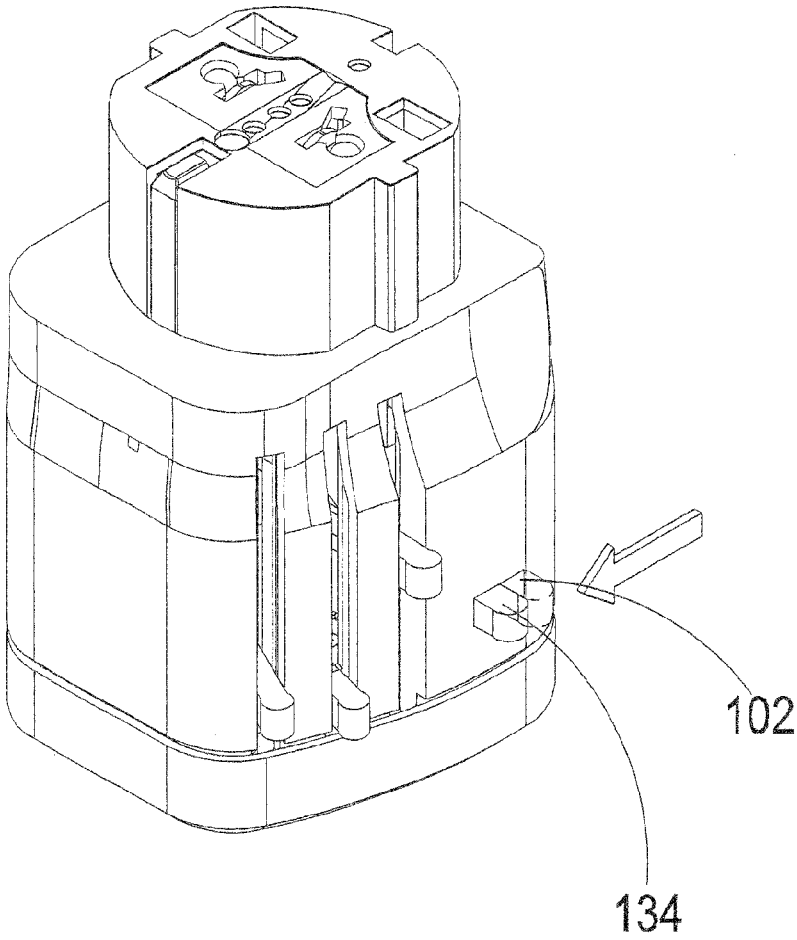
FIG. 16 is a perspective view demonstrating a first phase of an operation of a third plugging unit (Taiwan/American/Japanese style pin arrangement) according to the present invention.
Figure 17:
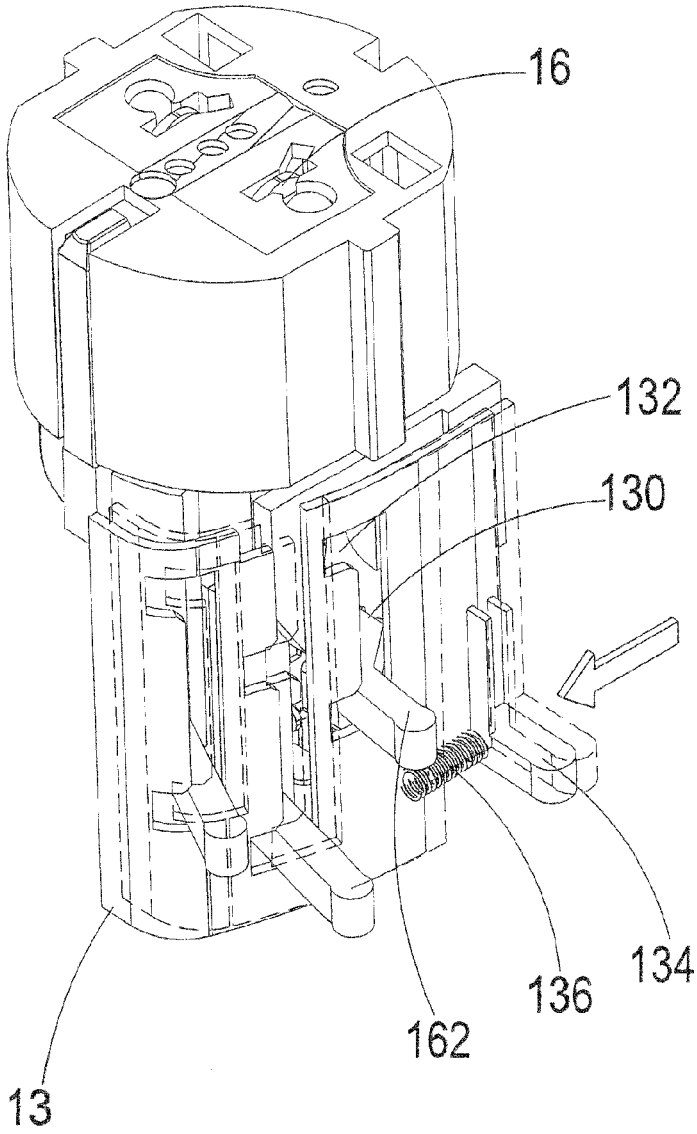
FIG. 17 is a perspective view illustrating internal component movement associated with the operation of FIG. 16.
Figure 18:
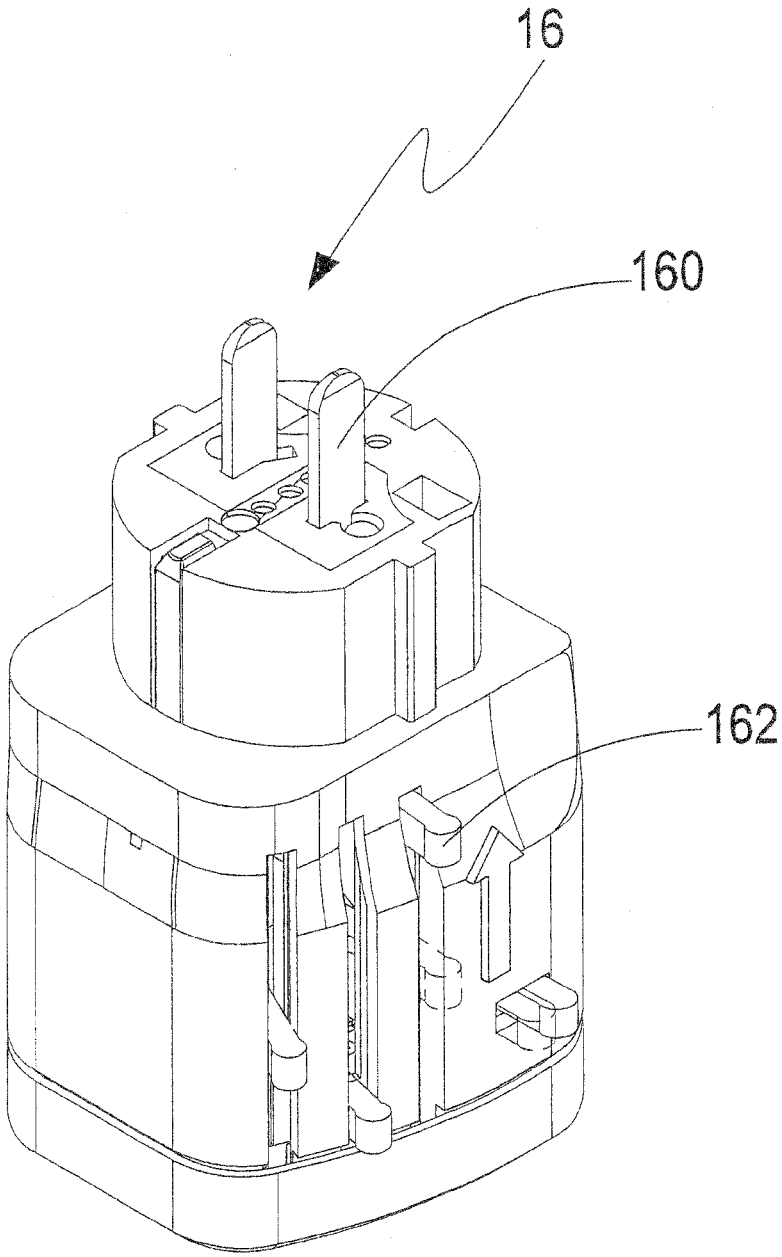
FIG. 18 is a perspective view demonstrating a second phase of the operation of the third plugging unit (Taiwan/American/Japanese style pin arrangement) according to the present invention.

Referring to FIGS. 16, 17, 18, 19, and 20, which are respectively a perspective view demonstrating a first phase of an operation of the third plugging unit (Taiwan/American/Japanese style pin arrangement), a perspective view illustrating internal component movement associated with the operation of FIG. 16, a perspective view demonstrating a second phase of the operation of the third plugging unit (Taiwan/American/Japanese style pin arrangement), a perspective view illustrating internal component movement associated with the operation of FIG. 18, and a perspective view demonstrating installation of the grounding conductive member for the Taiwan/American/Japanese style pin arrangement, to use the American style pin arrangement, the operation and structure are as follows. Firstly, the switching member 134 of the constraint plate 13 is pushed to cause the switching member 134 to move along the slide channel 102. Under this condition, the elastic member 136 of the constraint plate 13 is compressed. Since the constraint plate 13 is moved, for example, rightwards, the operation peg 162 of the third plugging unit 16 is moved from one of the locking sections 132, where the operation peg is originally located, into the associated constraint passage 130. This allows a user to push the operation peg 162 upward, thereby making the conductive pins 160 of the third plugging unit 16 projecting outwards.

Once the operation peg 162 is moved to the uppermost position, the constraint plate 13 is driven by the spring force released from the elastic member 136 to return to the original position, so as to have the operation peg 162 entering and engaging another one of the locking sections 132, thereby effectively securing the third plugging unit 16 in the locking section. On the other hand, to retract the conductive pins 160 of the third plugging unit 16, a revered operation is performed.

Figure 20:
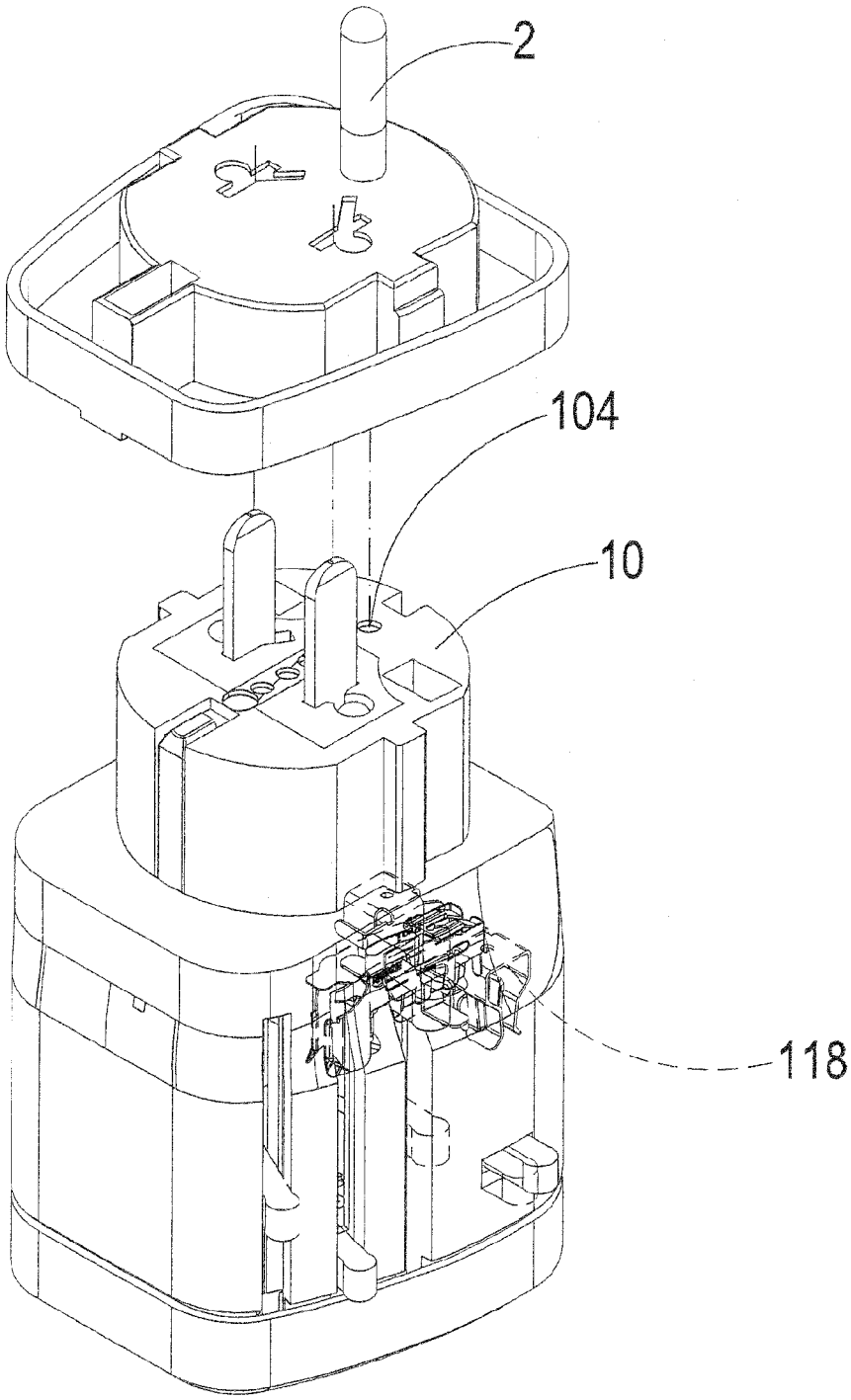
FIG. 20 is a perspective view illustrating installation of a grounding conductive member for the Taiwan/American/Japanese style pin arrangement.

FIG. 20 illustrates that the grounding conductive member 2 can be directly fit to the through hole 104 formed in the top wall of the outer enclosure 10, so that a user may directly insert the grounding conductive member 2 into the through holes 104 according to local voltage requirement. Taking a South African grounding conductive member 2 as an example, the grounding conductive member 2 is connected to the conductive spring plate 118 and the through hole 104 is provided, similar to the through hole 104 shown in FIG. 10, for installation of the grounding conductive member 2. The through hole 104 of FIG. 10 allows the grounding conductive member 2 to be fit thereto or embedded therein, but the through hole 104 of the currently discussed drawing can only allow for embedding.

Figure 21:
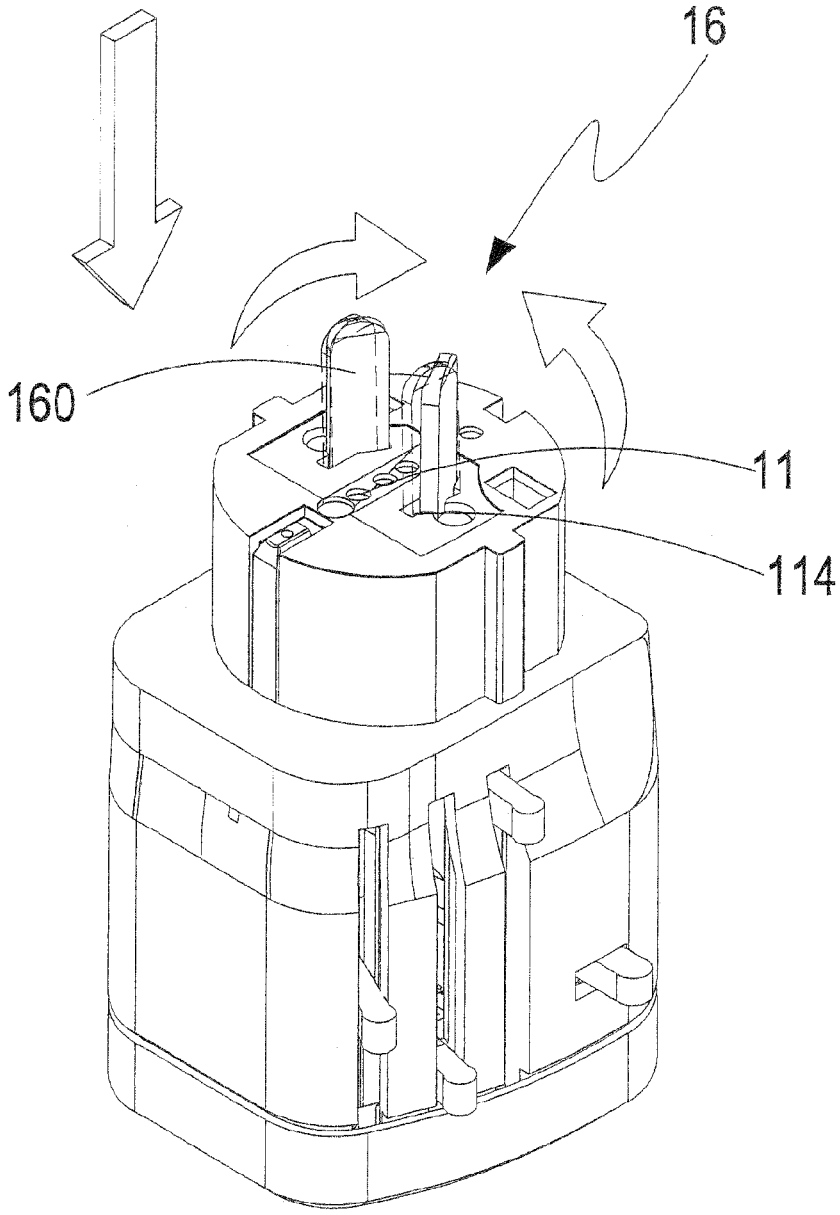
FIG. 21 is a perspective view demonstrating an operation of the third plugging unit (Australasian inclined style plug) according to the present invention.
Figure 22:
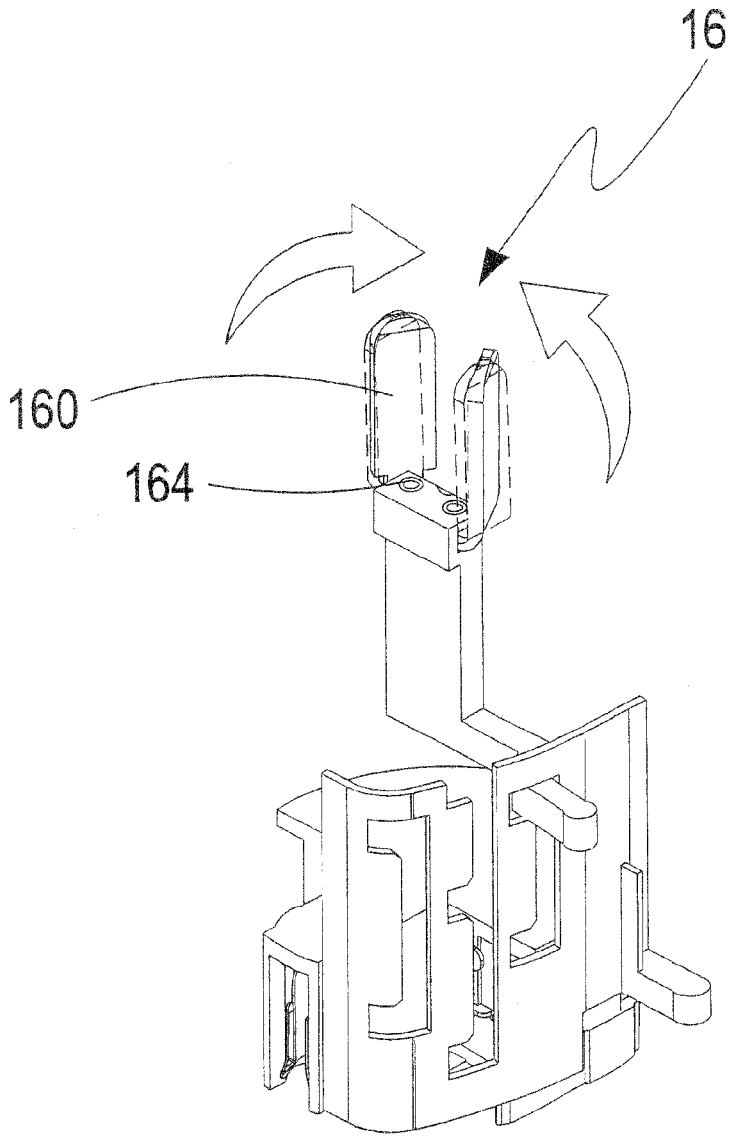
FIG. 22 is a perspective view illustrating an internal operation of the third plugging unit (Australasian inclined style plug) according to the present invention.

Referring to FIGS. 21 and 22, which are a perspective view demonstrating an operation of the third plugging unit (Australasian inclined style plug) according to the present invention and a perspective view illustrating an internal operation of the third plugging unit (Australasian inclined style plug), to use the Australasian inclined style plug, the conductive pins 160 of the third plugging unit 16 are rotated so as to correspond to the locations of the through openings 114 defined in the top of the inner housing 11. To realize rotation of the conductive pins 160 of the third plugging unit 16, the third plugging unit 16 is provided with the rotation members 164. When the conductive pins 160 are manipulated, the rotation members 164 allow the conductive pins 160 to change directions to thereby meet the specifications of Australasian style plug.

Figure 23:
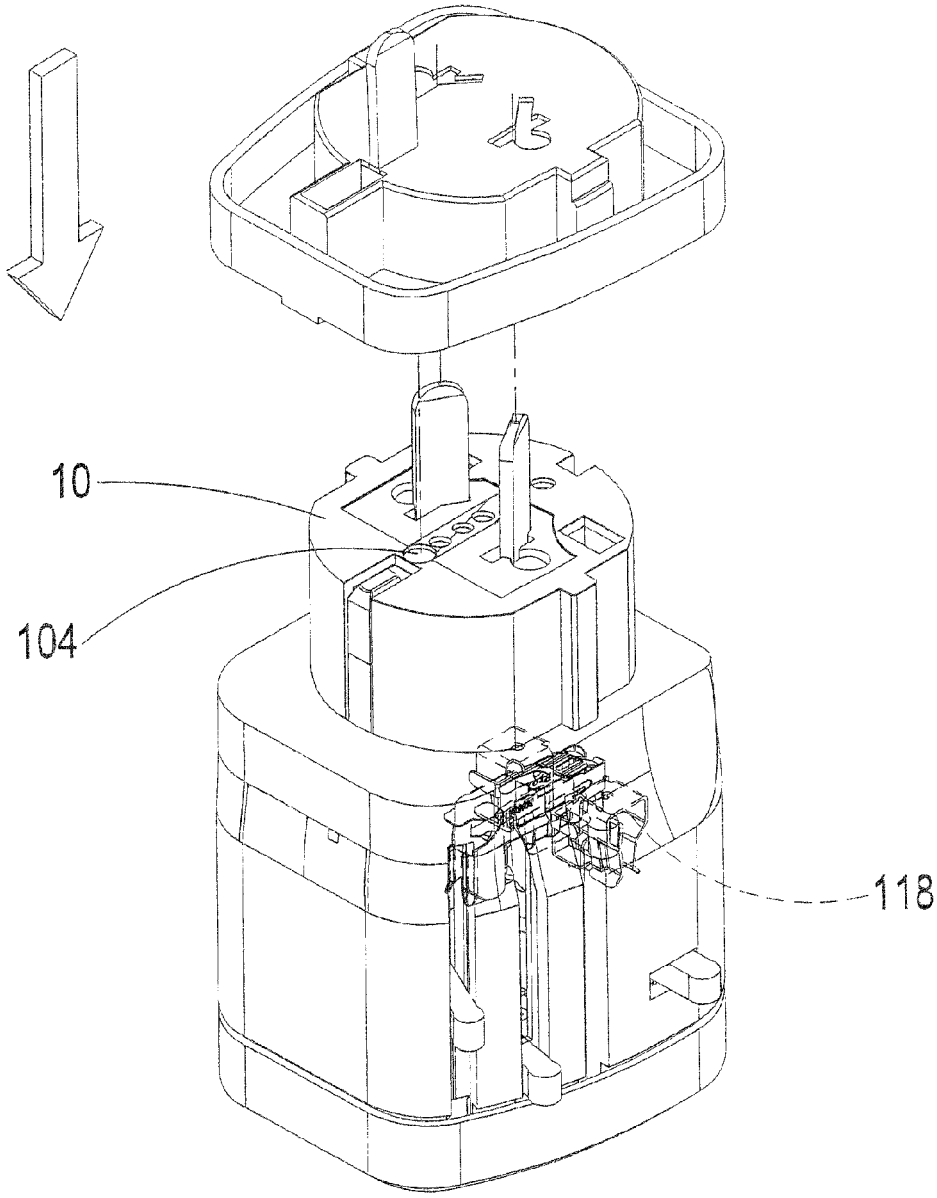
FIG. 23 is a perspective view demonstrating installation of a grounding conductive member for Australasian inclined style plug.

Referring to FIG. 23, which is a perspective view demonstrating installation of the grounding conductive member for Australasian inclined style plug, to provide the German/French style plug 1 with the functions of protection against damaging factors, such as current leakage and surges, that might damage the electronic product, the through holes 104 are formed in the top wall of the outer enclosure 10 so that a user may insert the grounding conductive member 2 into the through holes 104 according to the local voltage requirement and having the grounding conductive member 2 connected to the conductive spring plate 118.

Figure 24:
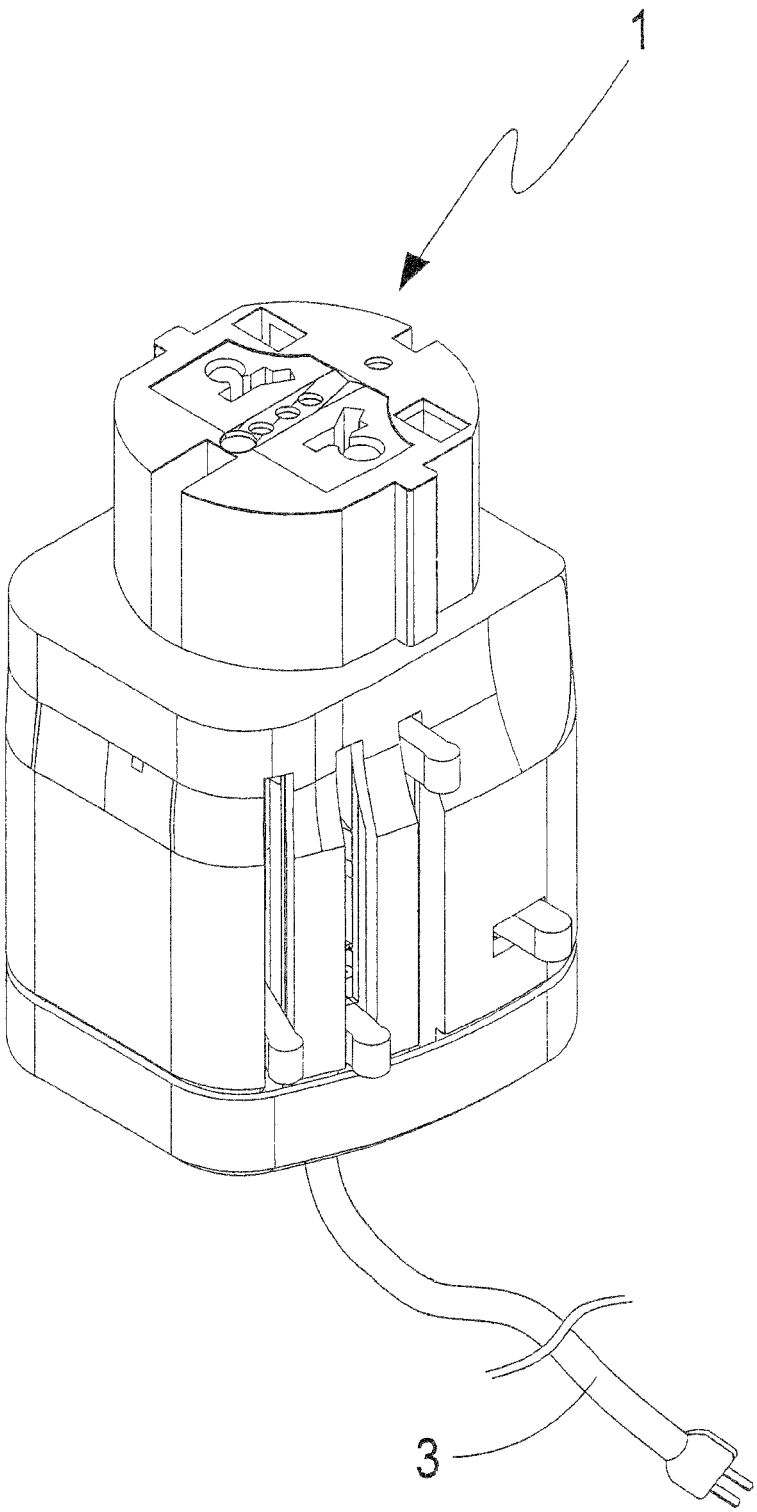
FIG. 24 is a perspective view illustrating combination of the present invention with a power cord.

Referring to FIG. 24, which is a perspective view illustrating combination of the present invention with a power cord, a power cord 3 can be connected to an end of the German/French style plug 1, whereby the power cord 3 allows the German/French style plug 1 to stretch out for connection with other electrical appliances.

The plugging unit 14, 15, 16 discussed above can be provided with a conductive spring plate 118 set at any desired location according local specifications of countries/areas for connection with the grounding conductive member 2.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A German/French style plug with multiple pin arrangements, comprising:

an outer enclosure, which has a side wall in which a plurality of slide channels is formed and a top wall adjacent to the side wall and forming a plurality of through holes, the outer enclosure forming therein a constraint rail;

an inner housing, which is received in the outer enclosure and has a wall forming a constraint member that is matingly engageable with the constraint rail and also forms a constraint slot at a location close to the constraint member, the inner housing has a top forming a plurality of through openings, the inner housing forming a retention projection extending from an outer surface thereof;

a stop plate, which is received in the outer enclosure and forms a retention trough in a portion projecting from a predetermined location thereof and engageable with the retention projection;

a constraint plate, which is received in the outer enclosure and forms a plurality of constraint passages corresponding to the slide channels;

at least one first plugging unit, which comprises at least one conductive pin receivable through the through holes;

a second plugging unit, which forms at least one conductive pin receivable through the through openings and comprises a constraint section that is formed on a predetermined location of the second plugging unit to engage the constraint slot, whereby the second plugging unit is movable in a limited way as being constrained by the inner housing to exhibit difference in vertical positioning; and at least one third plugging unit, which forms at least one conductive pin receivable through the through openings.

2. The German/French style plug with multiple pin arrangements according to claim 1 further comprising a base that is coupled to the outer enclosure and forms a plurality of coupling holes adapted to receive insertion of an external plug and in electrical connection with the plugging units.

3. The German/French style plug with multiple pin arrangements according to claim 1, wherein the inner housing forms a plurality of through holes for receiving selective insertion of a grounding conductive member therein.

4. The German/French style plug with multiple pin arrangements according to claim 3, wherein the outer enclosure receives therein a conductive spring plate that is electrically connected to the grounding conductive member.

5. The German/French style plug with multiple pin arrangements according to claim 1, wherein the third plugging unit comprises a rotation member that rotates the conductive pin for changing direction.

6. The German/French style plug with multiple pin arrangements according to claim 1, wherein the stop plate blocks a potion of the constraint passage along which the second plugging unit is movable.

7. The German/French style plug with multiple pin arrangements according to claim 1 further comprising at least one elastic member that is mounted to each of the stop plate and the constraint plate and is supported on an inside wall of the outer enclosure.

8. The German/French style plug with multiple pin arrangements according to claim 1, wherein each of the constraint passages forms a plurality of locking sections.

9. The German/French style plug with multiple pin arrangements according to claim 1, wherein the constraint plate comprises a switching member projecting therefrom to extend through the slide channels for an operation of position switching of the switching member.

10. The German/French style plug with multiple pin arrangements according to claim 1 further comprising at least one operation peg extending from a predetermined location of each of the first plugging unit, the second plugging unit, and the third plugging unit and movably received in the slide channels and constrained by the constraint passages.

* * * * *